US005750324A

United States Patent [19]

Mydlarz et al.

[11] Patent Number: 5,750,324

[45] Date of Patent: May 12, 1998

[54] HIGH CHLORIDE EMULSIONS WITH IMPROVED RECIPROCITY

[75] Inventors: Jerzy Z. Mydlarz, Fairport; Roger L. Klaus, Rochester; Franklin D. Saeva, Webster, all of N.Y.

[73] Assignee: Eastman Kodak Company, Rochester, N.Y.

[21] Appl. No.: 779,539

[22] Filed: Jan. 8, 1997

[51] Int. Cl.[6] ..... G03C 1/035; G03C 1/08; G03C 1/09

[52] U.S. Cl. ..... 430/567; 430/569; 430/599; 430/603; 430/605; 430/568

[58] Field of Search ..... 430/567, 569, 430/599, 603, 605, 568

[56] References Cited

U.S. PATENT DOCUMENTS

| | | | |
|---|---|---|---|
| 2,105,274 | 1/1938 | Steigmann | 430/398 |
| 3,554,758 | 1/1971 | Willems et al. | 430/602 |
| 3,817,753 | 6/1974 | Willems et al. | 430/265 |
| 3,928,043 | 12/1975 | Ciurca, Jr. | 430/212 |
| 5,605,789 | 2/1997 | Chen et al. | 430/567 |

FOREIGN PATENT DOCUMENTS

| | | | |
|---|---|---|---|
| 1552027 | 9/1979 | United Kingdom | 430/357 |

*Primary Examiner*—Mark F. Huff
*Attorney, Agent, or Firm*—Sarah Meeks Roberts

[57] ABSTRACT

This invention relates to a silver halide photographic element for digital exposure comprising a cubical silver chloride emulsion precipitated and/or chemically sensitized in the presence of an aryliodonium compound represented by the formula:

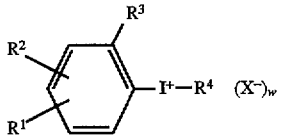

wherein $R^1$ and $R^2$ and $R^3$ are independently H, or aliphatic, aromatic or heterocyclic groups, alkoxy groups, hydroxy groups, halogen atoms, aryloxy groups, alkylthio groups, arylthio groups, acyl groups, sulfonyl groups, acyloxy groups, carboxyl groups, cyano groups, nitro groups, sulfo groups, alkylsulfoxide or trifluoralkyl groups, or any two of $R^1$, $R^2$ and $R^3$ together represent the atoms necessary to form a five or six-membered ring or a multiple ring system;

$R^4$ is a carboxylate salt or $0^-$; w is 0 or 1; and $X^-$ is an anionic counter ion; with the proviso that when $R^3$ is a carboxyl or sulfo group, w is 0 and $R^4$ is $0^-$.

23 Claims, No Drawings

HIGH CHLORIDE EMULSIONS WITH IMPROVED RECIPROCITY

FIELD OF THE INVENTION

The invention relates to a silver chloride photographic element useful in electronic printing.

BACKGROUND OF THE INVENTION

Many known imaging systems require that a hard copy be provided from an image which is in digital form. A typical example of such a system is electronic printing of photographic images which involves control of individual pixel exposure. Such a system provides greater flexibility and the opportunity for improved print quality in comparison to optical methods of photographic printing. In a typical electronic printing method, an original image is first scanned to create a digital representation of the original scene. The data obtained is usually electronically enhanced to achieve desired effects such as increased image sharpness, reduced graininess and color correction. The exposure data is then provided to an electronic printer which reconstructs the data into a photographic print by means of small discrete elements (pixels) that together constitute an image. In a conventional electronic printing method, the recording element is scanned by one or more high energy beams to provide a short duration exposure in a pixel-by-pixel mode using a suitable source such as a cathode ray tube (CRT), light emitting diode (LED) or laser. Such methods are described in the patent literature, including, for example, Hioki U.S. Pat. No. 5,126,235; European Patent Application 479 167 A1 and European Patent Application 502 508 A1. Also, many of the basic principles of electronic printing are provided in Hunt, *The Reproduction of Colour*, Fourth Edition, pages 306–307, (1987).

Silver halide emulsions having high chloride contents, i.e., greater than 50 mole percent chloride based on silver, are known to be very desirable in image-forming systems due to the high solubility of silver chloride which permits short processing times and provides less environmentally polluting effluents. Unfortunately, it is very difficult to provide a high chloride silver halide emulsion having the high sensitivity desired in many image-forming processes. Furthermore, conventional emulsions having high chloride contents exhibit significant losses in sensitivity when they are subjected to high energy, short duration exposures of the type used in electronic printing methods of the type described previously herein. Such sensitivity losses are typically referred to as high intensity reciprocity failure. This problem is exacerbated when iodide is added to the emulsion.

One compound that is used for reciprocity control is Iridium. Iridium may be used in precipitating the high chloride silver halide emulsions and/or during sensitization of those emulsions. The presence of iridium, however, significantly reduces speed, degrades contrast and shoulder (optical exposure), and reduces latent image keeping (LIK) stability, particularly when added during the make.

The inventors in the current invention have discovered that the use of certain iodonium salts improves reciprocity in chloride emulsions useful for electronic printing, without the above disadvantages.

Various phenyliodonium salts have been described in U.S. Pat. Nos. 2,105,274 and 3,817,753 as silver halide development antifoggants and development modifiers Diaryliodonium salts of mercuric halides have been described in U.S. Pat. No. 3,554,758 as silver halide fog inhibitors. Organic iodyl compounds are described in U.S. Pat. No. 3,928,043 as oxidants for leuco dyes, particularly in color diffusion transfer elements. Organic multivalent iodine compounds are described in GB 1,552,027 as intensifying agents when added to a photographic material or processing solutions for color silver halide materials. However, there is no suggestion in the art that aryliodonium compounds may be utilized to improve reciprocity in high chloride elements as described hereafter.

SUMMARY OF THE INVENTION

This invention provides a silver halide photographic element for digital exposure comprising a cubical silver chloride emulsion precipitated and/or chemically sensitized in the presence of an aryliodonium compound represented by the formula:

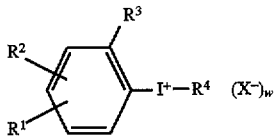

wherein $R^1$ and $R^2$ and $R^3$ are independently H, or aliphatic, aromatic or heterocyclic groups, alkoxy groups, hydroxy groups, halogen atoms, aryloxy groups, alkylthio groups, arylthio groups, acyl groups, sulfonyl groups, acyloxy groups, carboxyl groups, cyano groups, nitro groups, sulfo groups, alkylsulfoxide or trifluoralkyl groups, or any two of $R^1$, $R^2$ and $R^3$ together represent the atoms necessary to form a five or six-membered ring or a multiple ring system;

$R^4$ is a carboxylate salt or $0^-$; w is 0 or 1; and $X^-$ is an anionic counter ion; with the proviso that when $R^3$ is a carboxyl or sulfo group, w is 0 and $R^4$ is $0^-$. It further provides a method of making theemulsions utilized in the photographic element.

The photographic elements of this invention are suitable for short duration and high energy exposure. The presence of aryliodonium compounds in the silver chloride cubical emulsion improves high intensity reciprocity. Further, in contrast to some other compounds which have been utilized to improve reciprocity, the aryliodonium compounds actually increase the sensitivity of the emulsion.

DETAILED DESCRIPTION OF THE INVENTION

The aryliodonium carboxylate compounds utilized in this invention are represented by the following formula:

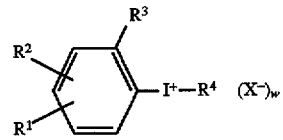

wherein $R^1$ and $R^2$ and $R^3$ can be any substituents which are suitable for use in a silver halide photographic element and which do not interfere with the reciprocity improving activity of the aryliodonium compound. $R^1$, $R^2$ and $R^3$ may be independently H, or a substituted or unsubstituted aliphatic, aromatic, or heterocyclic group or any two of $R^1$, $R^2$ and $R^3$ may together represent the atoms necessary to form a 5 or 6-membered ring or a multiple ring system. $R^1$, $R^2$ and $R^3$ may also be alkoxy groups (for example, methoxy, ethoxy, octyloxy), hydroxy groups, halogen atoms, aryloxy groups (for example, phenoxy), alkylthio groups (for example, methylthio, butylthio), arylthio groups (for example, phenylthio), acyl groups (for example, acetyl, propionyl, butyryl, valeryl), sulfonyl groups (for example, methylsulfonyl, phenylsulfonyl), acyloxy groups (for example, acetoxy, benzoxy), carboxyl groups, cyano groups, nitro groups, sulfo groups, alkylsulfoxide groups and trifluouroalkyl groups. In one preferred embodiment $R^1$, $R^2$ and $R^3$ are independently H, or aliphatic, aromatic or heterocyclic groups. In another preferred embodiment $R^1$ and $R^2$ are independently H, halogen atoms, or aliphatic, aromatic or heterocyclic groups and $R^3$ is a sulfo or carboxyl group.

When $R^1$, $R^2$ and $R^3$ are aliphatic groups, preferably, they are alkyl groups having from 1 to 22 carbon atoms, or alkenyl or alkynyl groups having from 2 to 22 carbon atoms. More preferably, they are alkyl groups having 1 to 10 carbon atoms, or alkenyl or alkynyl groups having 3 to 5 carbon atoms. Most preferably they are alkyl groups having 1 to 5 carbon atoms. These groups may or may not have substituents. Examples of alkyl groups include methyl, ethyl, propyl, butyl, pentyl, hexyl, octyl, 2-ethylhexyl, decyl, dodecyl hexadecyl, octadecyl, cyclohexyl, isopropyl and t-butyl groups. Examples of alkenyl groups include allyl and butenyl groups and examples of alkynyl groups include propargyl and butynyl groups.

The preferred aromatic groups have from 6 to 20 carbon atoms and include, among others, phenyl and naphthyl groups. More preferably, the aromatic groups have 6 to 10 carbon atoms and most preferably the aromatic groups are phenyl. These groups may be substituted or unsubstituted. The heterocyclic groups are 3 to 15-membered rings with at least one atom selected from nitrogen, oxygen, sulfur, selenium and tellurium. More preferably, the heterocyclic groups are 5 to 6-membered rings with at least one atom selected from nitrogen. Examples of heterocyclic groups include pyrrolidine, piperidine, pyridine, tetrahydrofuran, thiophene, oxazole, thiazole, imidazole, benzothiazole, benzoxazole, benzimidazole, selenazole, benzoselenazole, tellurazole, triazole, benzotriazole, tetrazole, oxadiazole, or thiadiazole rings.

Any one of $R^1$, $R^2$ and $R^3$ may together form a ring or multiple ring system. These ring systems may be unsubstituted or substituted. The ring and multiple ring systems formed by $R^1$, $R^2$ and $R^3$ may be alicyclic or they may be the aromatic and heterocyclic groups described above.

$R^4$ is a carboxylate salt such as acetate, formate, benzoate or trifluoroacetate, or other longer chain acids or $R^4$ is $0^-$. W is 0 or 1. When $R^3$ is a sulfo or carboxyl group w is 0 and $R^4$ is $0^-$.

$X^-$ is any anionic counter ion which is suitable for use in a photographic element and which does not interfere with the reciprocity improving effect of the compound. Preferably the counter ions are water soluble. Suitable examples of $X^-$ include $CH_3CO_2$, Cl, $CF_3SO_3$, $PF_6$, Br, $BF_4$, $AsF_6$, $CH_3SO_3$, $CF_3CO_2$, $CH_3C_6H_4SO_3$, $HSO_4$, $SbF_6$, and $CCl_3CO_2$. Particularly useful are $CH_3CO_2$, $CH_3SO_3$ and $PF_6$.

Nonlimiting examples of substituent groups for $R^1$, $R^2$ and $R^3$ and $R^4$ include alkyl groups (for example, methyl, ethyl, hexyl), alkoxy groups (for example, methoxy, ethoxy, octyloxy), aryl groups (for example, phenyl, naphthyl, tolyl), hydroxy groups, halogen atoms, aryloxy groups (for example, phenoxy), alkylthio groups (for example, methylthio, butylthio), arylthio groups (for example, phenylthio), acyl groups (for example, acetyl, propionyl, butyryl, valeryl), sulfonyl groups (for example, methylsulfonyl, phenylsulfonyl), acylamino groups, sulfonylamino groups, acyloxy groups (for example, acetoxy, benzoxy), carboxyl groups, cyano groups, sulfo groups, and amino groups. Preferred substituents are lower alkyl groups, i.e., those having 1 to 4 carbon atoms (for example, methyl) and halogen groups (for example, chloro).

Specific examples of the aryliodonium compounds include, but are not limited to

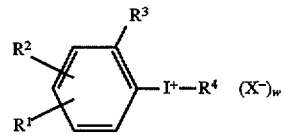

| Compound | $R^1$ | $R^2$ | $R^3$ | $R^4$ | W | X |
|---|---|---|---|---|---|---|
| 1 | H | H | H | $OCOCH_3$ | 1 | $OCOCH_3$ |
| 2 | H | H | H | $OCOCF_3$ | 1 | $OCOCF_3$ |
| 3 | H | $CH_3$ | H | $OCOCH_3$ | 1 | $OCOCH_3$ |
| 4 | H | $CH_3$ | $CO_2H$ | $0^-$ | 0 | — |
| 5 | H | H | $CO_2H$ | $0^-$ | 0 | — |
| 6 | H | CN | $CO_2H$ | $0^-$ | 0 | — |
| 7 | $OCH_3$ | $CH_3$ | H | $OCOCH_3$ | 1 | $OCOCH_3$ |
| 8 | $CH_3$ | $CH_3$ | $CH_3$ | $OCOCH_3$ | 1 | $OCOCH_3$ |
| 9 | $CH_3$ | $CH_3$ | H | $OCOCH_3$ | 1 | $OCOCH_3$ |
| 10 | H | H | H | OCOH | 1 | OCOH |
| 11 | H | $CH_3$ | H | OCOH | 1 | OCOH |
| 12 | $CH_3$ | $CH_3$ | $CO_2H$ | $0^-$ | 0 | — |
| 13 | H | H | $SO_3H$ | $0^-$ | 0 | — |
| 14 | H | CN | $CO_2H$ | $0^-$ | 0 | — |
| 15 | $OCH_3$ | Cl | H | $OCOCH_3$ | 1 | $OCOCH_3$ |
| 16 | $CO_2H$ | H | H | $OCOCH_3$ | 1 | $OCOCH_3$ |
| 17 | $OCH_3$ | Cl | $CH_3$ | $OCOCH_3$ | 1 | $OCOCH_3$ |
| 18 | H | H | H | $OCOCH_2CH_3$ | 1 | $OCOCH_2CH_3$ |
| 19 | H | $CH_2OH$ | H | $OCOCH_3$ | 1 | $OCOCH_3$ |
| 20 | Cl | $CH_2OH$ | $CO_2H$ | $0^-$ | 0 | — |
| 21 | Cl | $CH_3$ | $SO_3H$ | $0^-$ | 0 | — |
| 22 | $CH_3$ | CN | $CO_2H$ | $0^-$ | 0 | — |

-continued

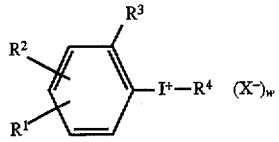

| Compound | $R^1$ | $R^2$ | $R^3$ | $R^4$ | W | X |
|---|---|---|---|---|---|---|
| 23 | $CF_3$ | Cl | H | $OCOCH_3$ | 1 | $OCOCH_3$ |
| 24 | $CO_2H$ | H | H | $OCOCH_3$ | 1 | $OCOCH_3$ |
| 25 | $OCCH_3$ | H | $C_6H_5$ | $OCOCH_3$ | 1 | $OCOCH_3$ |
| 26 | $C_6H_5$ | H | H | $OCOCH_3$ | 1 | $OCOCH_2CH_3$ |
| 27 | $C_6H_4CO_2H$ | H | H | $OCOCH_3$ | 1 | $OCOCH_3$ |
| 28 | H | $CH_2OH$ | $CO_2H$ | $0^-$ | 0 | — |
| 29 | $SO_2CH_3$ | H | H | $OCOCH_3$ | 1 | $OCOCH_3$ |
| 30 | Cl | CN | $CO_2H$ | $0^-$ | 0 | — |
| 31 | $CF_3$ | $OCH_3$ | H | $OCOCH_3$ | 1 | $OCOCH_3$ |
| 32 | $CO_2H$ | $CO_2H$ | H | $OCOCH_3$ | 1 | $OCOCH_3$ |

Compounds 1, 2, 5, 10, 12, 16, 19, 24, 25, and 29 are examples of particularly suitable compounds for use in this invention.

The aryliodonium compounds are readily synthesized by reaction of the iodosoaryl compound and the corresponding anhydride as discussed in Org. Syn., 1961 and in "Advanced Organic Chemistry," by Fieser & Fieser, Reinhold, NY, 1961 and as shown below:

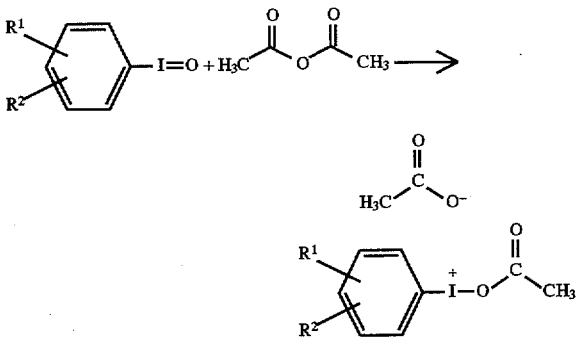

Many of these compounds are commercially available.

It is understood throughout this specification and claims that any reference to a substituent by the identification of a group or a ring containing a substitutable hydrogen (e.g., alkyl, amine, aryl, alkoxy, heterocyclic, etc.), unless otherwise specifically described as being unsubstituted or as being substituted with only certain substituents, shall encompass not only the substituent's unsubstituted form but also its form substituted with any substituents which do not negate the advantages of this invention. Nonlimiting examples of suitable substituents are as described above for the substituent groups for $R^1$, $R^2$, $R^3$ and $R^4$.

Useful levels of the aryliodonium compounds range from about $1\times10^{-9}$ to $10\times10^{-3}$ mol/mol Ag. The amount to be added is somewhat dependent on the point of addition. If the compound is added after precipitation preferred levels range from about $10\times10^{-7}$ to $1\times10^{-3}$ mol/mol Ag. If the aryliodonium compound is added at the start of or during precipitation the preferred range is from about $1\times10^{-9}$ to $1\times10^{-4}$ mol/mol Ag.

The aryliodonium compounds may be added to the photographic emulsion using any technique suitable for this purpose. They may be dissolved in most common organic solvents, for example, methanol or acetone. The compounds can be added to the emulsion in the form of a liquid/liquid dispersion similar to the technique used with certain couplers. They can also be added as a solid particle dispersion.

The aryliodonium compounds may be used in addition to any conventional compound utilized for reciprocity improvement as commonly practiced in the art. Combinations of more than one aryliodonium compound may be utilized.

The aryliodonium compounds may be added to the silver halide emulsion at any time before or during precipitation and/or chemical sensitization. They may be added before or during precipitation in an amount which will wash out before the heat treatment of chemical sensitization, or they may be added before or during precipitaion in an amount which will result in some of the aryliodonium compound being present during the heat treatment which completes chemical sensitization so that the emulsion is chemically sensitized in the presence of the compound. They may also be added at any time after precipitation and before or during the heat treatment employed to complete chemical sensitization so that the emulsion is chemically sensitized in the presence of the compound. They may also be added both before or during precipitation and before or during chemical sensitization so that the beneficial aspects of the compounds are available at all stages of precipitation and chemical sensitization. More preferably the compounds are added at the start of or during precipitation of the emulsion.

The photographic print elements of the invention are comprised of a reflective support and, coated on the support, at least one radiation-sensitive cubical grain high chloride imaging emulsion. The term "high chloride" in referring to silver halide grains and emulsions means an overall chloride concentration of at least 90 mole percent, more preferably at least 95 mole percent, and most preferably at least 97 mole percent, based on total silver. In referring to grains and emulsions containing two or more halides, the halides are named in their order of ascending concentrations. Grains and emulsions referred to as "silver bromochloride" or "silver iodochloride" can, except as otherwise indicated, contain impurity or functionally insignificant levels of the unnamed halide (e.g., less than 0.5 M %, based on total silver). The term "total silver" is used to indicate all of the silver forming an entire grain or an entire grain population. Other references to "silver" refer to the silver forming the relevant portion of the grain structure—i.e., the region, portion, zone or specific location under discussion.

The term "cubic grain" is employed to indicate a grain is that bounded by six {100} crystal faces. Typically the corners and edges of the grains show some rounding due to ripening, but no identifiable crystal faces other than the six {100} crystal faces. The six {100} crystal faces form three pairs of parallel {100} crystal faces that are equidistantly spaced. The term "cubical grain" is employed to indicate grains that are at least in part bounded by {100} crystal faces satisfying the relative orientation and spacing of cubic grains. That is, three pairs of parallel {100} crystal faces are equidistantly spaced. Cubical grains include both cubic grains and grains that have one or more additional identifiable crystal faces. For example, tetradecahedral grains having six {100} and eight {111} crystal faces are a common form of cubical grains.

The emulsions of the present invention may be any high chloride cubical emulsion, including "pure" silver chloride emulsions. Any convenient conventional high chloride cubical grain precipitation procedure may be utilized such as those described in *Research Disclosure* 36544 of September 1994 in Sections I–III, or *Research Disclosure* 37038 of February 1995 in Section XV. *Research Disclosure* is published by Kenneth Mason Publications, Ltd., Dudley House, 12 North St., Emsworth, Hampshire P010 7DQ, England.

In one suitable embodiment the emulsions contain cubical silver iodochloride grains. The high sensitivity of such emulsions is obtained by the iodide incorporation within the grains and, more specifically, the placement of the iodide within the grains, i.e. by the controlled, non-uniformly distributed incorporation of iodide within the grains. Specifically, after at least 50 (preferably 85) percent of total silver forming the grains has been precipitated to form a core portion of the grains, a maximum iodide concentration is located within a shell that is formed on the host (core) grains, and the maximum iodide concentration containing shell is then converted to a sub-surface shell by precipitating silver and chloride ions without further iodide addition.

The silver iodochloride grains show enhanced performance with iodide concentrations ranging from 0.05 to 3.0 mole percent, based on total silver. Preferably overall iodide concentrations range from 0.1 to 1.0 mole percent, based on total silver. More important than the overall iodide concentration within the silver iodochloride grains is the placement of the iodide.

Iodide incorporation in the core portions of the grains adds iodide with no significant enhancement of photoefficiency. To avoid unnecessarily elevating overall iodide levels, it is contemplated that the iodide concentrations in the central (core) portions of the grains in all instances be less than the maximum incorporated iodide concentration. Preferably the iodide concentration in the core portions of the grains is less than half the average overall iodide concentration and, optimally, the core is substantially free of iodide—that is, formed without intentionally adding iodide. In comparing emulsions containing the same overall levels of iodide, speed enhancements are directly related to the extent to which iodide is excluded from the central portions of the grains.

Iodide addition onto the core portions of the grains creates a silver iodochloride shell on the host (core) grains. Attempts to use these shelled grains in photographic print elements without further modification results in markedly inferior performance. Having high iodide concentrations at the surface of the grains lowers speed as compared to the emulsions satisfying the requirements of the invention when both emulsions are sensitized to the same minimum density and otherwise produces elevated levels of minimum density that are incompatible with acceptable performance characteristics of photographic reflective print elements.

To increase speed and lower minimum density an iodide-free shell is precipitated onto the silver iodochloride shell, converting it into a sub-surface shell. The depth to which sub-surface shell is buried is chosen to render the iodide in the sub-surface shell inaccessible to the developing agent at the outset of development of latent image bearing grains and inaccessible throughout development in the grains that do not contain a latent image. The thickness of the surface shell is contemplated to be greater than 25 Å in emulsions employed in reflection print photographic elements. The surface shell thickness can, of course, range up to any level compatible with the minimum core requirement of 50 (preferably 85) percent of total silver. Since the sub-surface shell can contribute as little as 0.05 mole percent iodide, based on total silver, it is apparent that surface shells can account for only slightly less than all of the silver not provided by the core portions of the grains. A surface shell accounting for just less than 50 (preferably just <15) percent of total silver is specifically contemplated.

The presence of a maximum iodide concentration in the sub-surface shell is in itself sufficient to increase photographic speed. It has been additionally observed that further enhancements in photographic speed attributable to iodide incorporation in the sub-surface shell are realized when the emulsions exhibit a unique stimulated fluorescent emission spectral profile. Specifically, it has been observed that further enhanced photographic sensitivity is in evidence in emulsions that, when stimulated with 390 nm radiation at 10° K, produce a peak stimulated fluorescent emission in the wavelength range of from 450 to 470 nm that is at least twice the intensity of stimulated fluorescent emission at 500 nm (hereinafter referred to the reference emission wavelength). Emission at 500 nm is attributed to the chloride in the grains. In the absence of iodide (and hence the absence of iodide induced crystal lattice variances) the peak intensity of stimulated fluorescent emission in the wavelength range of from 450 to 470 nm is relatively low, typically less than that at the reference emission wavelength.

To achieve the crystal lattice defects that stimulate a peak fluorescent emission in the wavelength range of from 450 to 470 nm more than twice the reference wavelength emission, only very low levels of iodide, based on total silver, are required. It is not the overall concentration of iodide that determines the fluorescent emission profile or emulsion sensitivity, but the crystal lattice defects that the iodide, when properly introduced, create. Slow iodide ion introductions that anneal out crystal lattice defects can incorporate iodide ion concentrations in excess of the minimum levels noted above without creating the stimulated emission profiles exhibited by the emulsions of the highest levels of sensitivity. Parameters that promote enhanced sensitivity are (1) increased localized concentrations of iodide, and/or (2) abrupt introductions of iodide ion during precipitation (sometimes referred to as "dump iodide" addition). When coupled with (1) and/or (2), increased overall iodide concentrations also contribute the achieving higher levels of photoefficiency. Increasing overall iodide concentrations without following the placement requirements can increase photographic speed, but this produces the disadvantages of elevated iodide ion incorporation that have been reported and avoided in selecting emulsions for photographic reflection print elements.

It was initially observed that, after starting with monodisperse silver chloride cubic grains (i.e., grains consisting of six {100} crystal faces), iodide introduction produced tetradecahedral grains (i.e., , grains consisting of six {100} crystal faces and eight {111} crystal faces). Further investigations revealed that as few as one {111} crystal face are sometimes present in the completed grains. On still further investigation, it has been observed that the emulsions of the invention can be cubic grain emulsions. Thus, although the presence of at least {111} crystal face (and usually tetradecahedral grains), provides a convenient visual clue that the grains may have been prepared according to the teaching of this invention, it has now been concluded that one or more {111} crystal faces are a by-product of grain formation that can be eliminated or absent without compromising the unexpected performance advantages of the invention noted above.

The preparation of cubical grain silver iodochloride emulsions with iodide placements that produce increased photographic sensitivity can be undertaken by employing any convenient conventional high chloride cubical grain precipitation procedure prior to precipitating the region of maximum iodide concentration—that is, through the introduction of at least the first 50 (preferably at least the first 85) percent of silver precipitation. The initially formed high chloride cubical grains then serve as hosts for further grain growth. In one specifically contemplated preferred form the host emulsion is a monodisperse silver chloride cubic grain emulsion. Low levels of iodide and/or bromide, consistent with the overall composition requirements of the grains, can also be tolerated within the host grains. The host grains can include other cubical forms, such as tetradecahedral forms. Techniques for forming emulsions satisfying the host grain requirements of the preparation process are well known in the art. For example, prior to growth of the maximum iodide concentration region of the grains, the precipitation procedures of Atwell U.S. Pat. No. 4,269,927, Tanaka EPO 0 080 905, Hasebe et al U.S. Pat. No. 4,865,962, Asami EPO 0 295 439, Suzumoto et al U.S. Pat. No. 5,252,454 or Ohshima et al U.S. Pat. No. 5,252,456, the disclosures of which are here incorporated by reference, can be employed, but with those portions of the preparation procedures, when present, that place bromide ion at or near the surface of the grains being omitted. Stated another way, the host grains can be prepared employing the precipitation procedures taught by the citations above through the precipitation of the highest chloride concentration regions of the grains they prepare.

Once a host grain population has been prepared accounting for at least 50 percent (preferably at least 85 percent) of total silver has been precipitated, an increased concentration of iodide is introduced into the emulsion to form the region of the grains containing a maximum iodide concentration. The iodide ion is preferably introduced as a soluble salt, such as an ammonium or alkali metal iodide salt. The iodide ion can be introduced concurrently with the addition of silver and/or chloride ion. Alternatively, the iodide ion can be introduced alone followed promptly by silver ion introduction with or without further chloride ion introduction. It is preferred to grow the maximum iodide concentration region on the surface of the host grains rather than to introduce a maximum iodide concentration region exclusively by displacing chloride ion adjacent the surfaces of the host grains.

To maximize the localization of crystal lattice variances produced by iodide incorporation it is preferred that the iodide ion be introduced as rapidly as possible. That is, the iodide ion forming the maximum iodide concentration region of the grains is preferably introduced in less than 30 seconds, optimally in less than 10 second. When the iodide is introduced more slowly, somewhat higher amounts of iodide (but still within the ranges set out above) are required to achieve speed increases equal to those obtained by more rapid iodide introduction and minimum density levels are somewhat higher. Slower iodide additions are manipulatively simpler to accomplish, particularly in larger batch size emulsion preparations. Hence, adding iodide over a period of at least 1 minute (preferably at least 2 minutes) and, preferably, during the concurrent introduction of silver is specifically contemplated.

It has been observed that when iodide is added more slowly, preferably over a span of at least 1 minute (preferably at least 2 minutes) and in a concentration of greater than 5 mole percent, based the concentration of silver concurrently added, the advantage can be realized of decreasing grain-to-grain variances in the emulsion. For example, well defined tetradecahedral grains have been prepared when iodide is introduced more slowly and maintained above the stated concentration level. It is believed that at concentrations of greater than 5 mole percent the iodide is acting to promote the emergence of {111} crystal faces. Any local iodide concentration level can be employed up to the saturation level of iodide in silver chloride, typically about 13 mole percent. Maskasky U.S. Pat. No. 5,288,603, here incorporated by reference, discusses iodide saturation levels in silver chloride.

Further grain growth following precipitation of the maximum iodide concentration region can be undertaken by any convenient conventional technique. Conventional double-jet introductions of soluble silver and chloride salts can be precipitate silver chloride as a surface shell. Alternatively, particularly where a relatively thin surface shell is contemplated, a soluble silver salt can be introduced alone, with additional chloride ion being provided by the dispersing medium.

At the conclusion of grain precipitation the grains can take varied cubical forms, ranging from cubic grains (bounded entirely by six {100} crystal faces), grains having an occasional identifiable {111} face in addition to six {100} crystal faces, and, at the opposite extreme tetradecahedral grains having six {100} and eight {111} crystal faces.

After examining the performance of emulsions exhibiting varied cubical grain shapes, it has been concluded that the performance of these emulsions is principally determined by iodide incorporation and the uniformity of grain size dispersity. The silver iodochloride grains are relatively monodisperse. The silver iodochloride grains preferably exhibit a grain size coefficient of variation of less than 35 percent and optimally less than 25 percent. Much lower grain size coefficients of variation can be realized, but progressively smaller incremental advantages are realized as dispersity is minimized.

In the course of grain precipitation one or more dopants (grain occlusions other than silver and halide) can be introduced to modify grain properties. For example, any of the various conventional dopants disclosed in *Research Disclosure*, Vol. 365, September 1994, Item 36544, Section I. Emulsion grains and their preparation, sub-section G. Grain modifying conditions and adjustments, paragraphs (3), (4) and (5), can be present in the emulsions of the invention. In addition it is specifically contemplated to dope the grains with transition metal hexacoordination complexes containing one or more organic ligands, as taught by Olm et al U.S. Pat. No. 5,360,712, the disclosure of which is here incorporated by reference.

The dispersing medium contained in the reaction vessel prior to the nucleation step is comprised of water, the dissolved chloride ions and a peptizer. The peptizer can take any convenient conventional form known to be useful in the precipitation of photographic silver halide emulsions. A summary of conventional peptizers is provided in *Research Disclosure*, September 1994, Item 36544, Section II.

*Research Disclosure* is published by Kenneth Mason Publications, Ltd., Emsworth, Hampshire P010 7DD, England. While synthetic polymeric peptizers of the type disclosed by Maskasky U.S. Pat. No. 4,400,463, can be employed, it is preferred to employ gelatino peptizers (e.g., gelatin and gelatin derivatives). Particularly preferred is oxidized, low methionine gelatin. As manufactured and employed in photography gelatino peptizers typically contain significant concentrations of calcium ion, although the use of deionized gelatino peptizers is a known practice. In the latter instance it is preferred to compensate for calcium ion removal by adding divalent or trivalent metal ions, such alkaline earth or earth metal ions, preferably magnesium, calcium, barium or aluminum ions. Specifically preferred peptizers are low methionine gelatino peptizers (i.e., those containing less than 30 micromoles of methionine per gram of peptizer), optimally less than 12 micromoles of methionine per gram of peptizer. These peptizers and their preparation are described by Maskasky U.S. Pat. No. 4,713,323 and King et al U.S. Pat. No. 4,942,120. It is conventional practice to add gelatin, gelatin derivatives and other vehicles and vehicle extenders to prepare emulsions for coating after precipitation. Any naturally occurring level of methionine can be present in gelatin and gelatin derivatives added after precipitation is complete; however, low levels of methionine (as in oxidized gelatins) is preferred.

The high chloride emulsions of the invention are chemically sensitized with sulfur and gold at pAg levels of from 5 to 10, pH levels of from 5 to 8 and temperatures of from 30 to 80° C., as illustrated by *Research Disclosure*, Vol. 120, April, 1974, Item 12008, *Research Disclosure, Vol.* 134, June, 1975, Item 13452, Sheppard et al U.S. Pat. No. 1,623,499, Matthies et al U.S. Pat. No. 1,673,522, Waller et al U.S. Pat. No. 2,399,083, Damschroder et al U.S. Pat. No. 2,642,361, McVeigh U.S. Pat. No. 3,297,447, Dunn U.S. Pat. No. 3,297,446, McBride U.K. Patent 1,315,755, Berry et al U.S. Pat. No. 3,772,031, Gilman et al U.S. Pat. No. 3,761,267, Ohi et al U.S. Pat. No. 3,857,711, Klinger et al U.S. Pat. No. 3,565,633, Oftedahl U.S. Pat. Nos. 3,901,714 and 3,904,415 and Simons U.K. Patent 1,396,696 and Deaton U.S. Pat. No. 5,049,485; the amount of the sulfur sensitizer can be properly selected according to conditions such as grain size, chemical sensitization temperature, pAg, and pH; chemical sensitization being optionally conducted in the presence of thiocyante derivatives as described in Damschroder U.S. Pat. No. 2,642,361; thioether compounds as disclosed in Lowe et al U.S. Pat. No. 2,521,926, Williams et al U.S. Pat. No. 3,021,215 and Bigelow U.S. Pat. No. 4,054,457; and azaindenes, azapyridazines and azapyrimidines as described in Dostes U.S. Pat. No. 3,411,914, Kuwabara et al U.S. Pat. No. 3,554,757, Oguchi et al U.S. Pat. No. 3,565,631 and Oftedahl U.S. Pat. No. 3,901,714. Sulfur plus gold sensitization of high chloride emulsion is also a subject matter of Mucke et al U.S. Pat. No. 4,906,558.

For the emulsions of this invention both high gold and sulfur plus gold finishes are preferred, especially when the source of gold sensitizer is a colloidal dispersion of gold sulfide. Other sources of gold can be any useful sources, as practiced in the art, for example as described in Deaton U.S. Pat. No. 5,049,485. The preferred high gold sensitization means that the amount of sulfur sensitizer should be less than 1 μmole per silver mole, and preferably less than 0.5 μmole per silver mole of the sensitized emulsion, whereas the gold compound comprises 0.10 to 100 milligrams of gold sulfide per mole of silver. The optimal amount of sulfur is between 0.5 and 0.05 μmole per silver mole of the sensitized emulsion. In the case of gold plus sulfur sensitization, the gold(I) compound may be added at levels from about $10^{-7}$ to about $10^{-3}$ mol thereof per mol of silver halide whereas sulfur may be added at levels from about $10^{-9}$ to about $10^{-4}$ mol thereof per mol of silver halide. A preferred concentrations of gold and sulfur compounds to achieve sensitization of silver halide is from about $10^{-6}$ to about $10^{-4}$ mol of gold and from about $10^{-7}$ to about $10^{-5}$ mol of sulfur thereof per mol of silver halide.

Chemical sensitization can take place in the presence of spectral sensitizing dyes as described by Philippaerts et al U.S. Pat. No. 3,628,960, Kofron et al U.S. Pat. No. 4,439,520, Dickerson U.S. Pat. No. 4,520,098, Maskasky U.S. Pat. No. 4,435,501, Ihama et al U.S. Pat. No. 4,693,965 and Ogawa U.S. Pat. No. 4,791,053. Chemical sensitization can be directed to specific sites or crystallographic faces on the silver halide grain as described by Haugh et al U.K. Patent Application 2,038,792A and Mifune et al published European Patent Application EP 302,528. The sensitivity centers resulting from chemical sensitization can be partially or totally occluded by the precipitation of additional layers of silver halide using such means as twin-jet additions or pAg cycling with alternate additions of silver and halide salts as described by Morgan U.S. Pat. No. 3,917,485, Becker U.S. Pat. No. 3,966,476 and *Research Disclosure*, Vol. 181, May, 1979, Item 18155. Also as described by Morgan, cited above, the chemical sensitizers can be added prior to or concurrently with the additional silver halide formation. Chemical sensitization can take place during or after halide conversion as described by Hasebe et al European Patent Application EP 273,404.

The emulsions used in the invention can be spectrally sensitized with dyes from a variety of classes, including the polymethine dye class, which includes the cyanines, merocyanines, complex cyanines and merocyanines (i.e., tri-, tetra- and polynuclear cyanines and merocyanines), styryls, merostyryls, streptocyanines, hemicyanines, arylidenes, allopolar cyanines and enamine cyanines. The aryliodonium compounds of this invention are particularly useful with a magenta or cyan finish.

The cyanine spectral sensitizing dyes include, joined by a methine linkage, two basic heterocyclic nuclei, such as those derived from quinolinium, pyridinium, isoquinolinium, 3H-indolium, benzindolium, oxazolium, thiazolium, selenazolinium, imidazolium, benzoxazolium, benzothiazolium, benzoselenazolium, benzotellurazolium, benzimidazolium, naphthoxazolium, naphthothiazolium, naphthoselenazolium, naphtotellurazolium, thiazolinium, dihydronaphthothiazolium, pyrylium and imidazopyrazinium quaternary salts.

The merocyanine spectral sensitizing dyes include, joined by a methine linkage, a basic heterocyclic nucleus of the cyanine-dye type and an acidic nucleus such as can be derived from barbituric acid, 2-thiobarbituric acid, rhodanine, hydantoin, 2-thiohydantoin, 4-thiohydantoin, 2-pyrazolin-5-one, 2-isoxazolin-5-one, indan-1,3-dione, cyclohexan-1,3-dione, 1,3-dioxane-4,6-dione, pyrazolin-3, 5-dione, pentan-2,4-dione, alkylsulfonyl acetonitrile, benzoylacetonitrile, malononitrile, malonamide, isoquinolin-4-one, chroman-2,4-dione, 5H-furan-2-one, 5H-3-pyrrolin-2-one, 1,1,3-tricyanopropene and telluracyclo-hexanedione.

One or more spectral sensitizing dyes may be employed. Dyes with sensitizing maxima at wavelengths throughout the visible and infrared spectrum and with a great variety of spectral sensitivity curve shapes are known. The choice and relative proportions of dyes depends upon the region of the spectrum to which sensitivity is desired and upon the shape of the spectral sensitivity curve desired. An example of a material which is sensitive in the infrared spectrum is shown in Simpson et al., U.S. Pat. No. 4,619,892, which describes a material which produces cyan, magenta and yellow dyes as a function of exposure in three regions of the infrared spectrum (sometimes referred to as "false" sensitization). Dyes with overlapping spectral sensitivity curves will often yield in combination a curve in which the sensitivity at each wavelength in the area of overlap is approximately equal to the sum of the sensitivities of the individual dyes. Thus, it is possible to use combinations of dyes with different maxima to achieve a spectral sensitivity curve with a maximum intermediate to the sensitizing maxima of the individual dyes.

Combinations of spectral sensitizing dyes can be used which result in supersensitization—that is, spectral sensitization greater in some spectral region than that from any concentration of one of the dyes alone or that which would result from the additive effect of the dyes. Supersensitization can be achieved with selected combinations of spectral sensitizing dyes and other addenda such as stabilizers and antifoggants, development accelerators or inhibitors, coating aids, brighteners and antistatic agents. Any one of several mechanisms, as well as compounds which can be responsible for supersensitization, are discussed by Gilman, *Photographic Science and Engineering*, Vol. 18, 1974, pp. 418–430.

Spectral sensitizing dyes can also affect the emulsions in other ways. For example, spectrally sensitizing dyes can increase photographic speed within the spectral region of inherent sensitivity. Spectral sensitizing dyes can also function as antifoggants or stabilizers, development accelerators or inhibitors, reducing or nucleating agents, and halogen acceptors or electron acceptors, as disclosed in Brooker et al U.S. Pat. No. 2,131,038, Illingsworth et al U.S. Pat. No. 3,501,310, Webster et al U.S. Pat. No. 3,630,749, Spence et al U.S. Patent 3,718,470 and Shiba et al U.S. Pat. No. 3,930,860.

Among useful spectral sensitizing dyes for sensitizing the emulsions described herein are those found in U.K. Patent 742,112, Brooker U.S. Pat. Nos. 1,846,300, '301, '302, '303, '304, 2,078,233 and 2,089,729, Brooker et al U.S. Pat. Nos. 2,165,338, 2,213,238, 2,493,747, '748, 2,526,632, 2,739,964 (Reissue 24,292), 2,778,823, 2,917,516, 3,352,857, 3,411,916 and 3,431,111, Sprague U.S. Pat. No. 2,503,776, Nys et al U.S. Pat. No. 3,282,933, Riester U.S. Pat. No. 3,660,102, Kampfer et al U.S. Pat. No. 3,660,103, Taber et al U.S. Pat. Nos. 3,335,010, 3,352,680 and 3,384,486, Lincoln et al U.S. Pat. No. 3,397,981, Fumia et al U.S. Pat. Nos. 3,482,978 and 3,623,881, Spence et al U.S. Pat. No. 3,718,470 and Mee U.S. Pat. No. 4,025,349, the disclosures of which are here incorporated by reference. Of particular importance are also amide, pyrrole, and furan substituted sensitizing dyes that afford reduced dye stain and short blue sensitizing dyes for color paper applications, as disclosed in *Research Disclosure*, Vol. 362, 1994, Item 36216, Page 291. Examples of useful supersensitizing-dye combinations, of non-light-absorbing addenda which function as supersensitizers or of useful dye combinations are found in McFall et al U.S. Pat. No. 2,933,390, Jones et al U.S. Pat. No. 2,937,089, Motter U.S. Pat. No. 3,506,443 and Schwan et al U.S. Pat. No. 3,672,898, the disclosures of which are here incorporated by reference.

Some amounts of spectral sensitizing dyes may remain in the emulsion layers after processing causing, what is known in the art, dye stain. Specifically designed for low stain dyes are disclosed in *Research Disclosure*, Vol. 362, 1994, Item 36216, Page 291.

Spectral sensitizing dyes can be added at any stage during the emulsion preparation. They may be added at the beginning of or during precipitation as described by Wall, *Photographic Emulsions*, American Photographic Publishing Co., Boston, 1929, p. 65, Hill U.S. Pat. No. 2,735,766, Philippaerts et al U.S. Pat. No. 3,628,960, Locker U.S. Pat. No. 4,183,756, Locker et al U.S. Pat. No. 4,225,666 and *Research Disclosure*, Vol. 181, May, 1979, Item 18155, and Tani et al published European Patent Application EP 301,508. They can be added prior to or during chemical sensitization as described by Kofron et al U.S. Pat. No. 4,439,520, Dickerson U.S. Pat. No. 4,520,098, Maskasky U.S. Pat. No. 4,435,501 and Philippaerts et al cited above. They can be added before or during emulsion washing as described by Asami et al published European Patent Application EP 287,100 and Metoki et al published European Patent Application EP 291,399. The dyes can be mixed in directly before coating as described by Collins et al U.S. Pat. No. 2,912,343. Small amounts of iodide can be adsorbed to the emulsion grains to promote aggregation and adsorption of the spectral sensitizing dyes as described by Dickerson cited above. Postprocessing dye stain can be reduced by the proximity to the dyed emulsion layer of fine high-iodide grains as described by Dickerson. Depending on their solubility, the spectral-sensitizing dyes can be added to the emulsion as solutions in water or such solvents as methanol, ethanol, acetone or pyridine; dissolved in surfactant solutions as described by Sakai et al U.S. Pat. No. 3,822,135; or as dispersions as described by Owens et al U.S. Pat. No. 3,469,987 and Japanese published Patent Application (Kokai) 24185/71. The dyes can be selectively adsorbed to particular crystallographic faces of the emulsion grain as a means of restricting chemical sensitization centers to other faces, as described by Mifune et al published European Patent Application 302,528. The spectral sensitizing dyes may be used in conjunction with poorly adsorbed luminescent dyes, as described by Miyasaka et al published European Patent Applications 270,079, 270,082 and 278,510.

The emulsions utilized herein can also be sensitized with a silver bromide Lippmann (fine grain) emulsion as described in U.S. Pat. No. 4,865,962 and U.S. Pat. No. 5,523,200. The fine grain silver bromide, also known as a Lippmann emulsion, has an average size range of between about 0.03 and about 0.1 microns. The preferred fine grain emulsion is greater than 98 mole percent silver bromide. The fine grain emulsion is added during the finishing of the emulsion before or after chemical sensitization. The preferred position of Lippmann bromide emulsion addition is finish format dependent and, in general, it may be added at any portion of the finishing cycle after heating for chemical sensitization.

The amount of fine grain Lippmann silver bromide added to the emulsion may vary between about 0.1 and about 3 mole % of total silver in the finished emulsion. A preferred range is between 0.3 and about 1.5 mole % of total silver in the emulsion for best speed/fog performance and reciprocity performance. The halide composition of the host high chloride emulsion may be pure silver chloride or it may contain small amounts (up to 1–2 mole %) of another halide such as bromide, iodide or combination thereof.

After sensitizing, the emulsion can be combined with any suitable coupler (whether two or four equivalent) and/or coupler dispersants to make the desired color film or print photographic materials; or they can be used in black and white photographic films and print material. Couplers which can be used in accordance with the invention are described in *Research Disclosure*, Vol. 176, 1978, Item 17643 Section VIII, *Research Disclosure* 308119 Section VII, and in particular in *Research Disclosure*, Vol. 370, 1995, Item 37038.

Instability which increases minimum density in negative-type emulsion coatings (i.e., fog) can be protected against by incorporation of stabilizers, antifoggants, antikinking agents, latent-image stabilizers and similar addenda in the emulsion and contiguous layers prior to coating. Most of the antifoggants effective in the emulsions used in this invention can also be used in developers and can be classified under a few general headings, as illustrated by C. E. K. Mees, *The Theory of the Photographic Process,* 2nd Ed., Macmillan, 1954, pp. 677–680.

To avoid such instability in emulsion coatings, stabilizers and antifoggants can be employed, such as halide ions (e.g., bromide salts); chloropalladates and chloropalladites as illustrated by Trivelli et al U.S. Pat. No. 2,566,263; water-soluble inorganic salts of magnesium, calcium, cadmium, cobalt, manganese and zinc as illustrated by Jones U.S. Pat. No. 2,839,405 and Sidebotham U.S. Pat. No. 3,488,709; mercury salts as illustrated by Allen et al U.S. Pat. No. 2,728,663; selenols and diselenides as illustrated by Brown et al U.K. Patent 1,336,570 and Pollet et al U.K. Patent 1,282,303; quaternary ammonium salts of the type illustrated by Allen et al U.S. Pat. No. 2,694,716, Brooker et al U.S. Pat. No. 2,131,038, Graham U.S. Pat. No. 3,342,596 and Arai et al U.S. Pat. No. 3,954,478; azomethine desensitizing dyes as illustrated by Thiers et al U.S. Pat. No. 3,630,744; isothiourea derivatives as illustrated by Herz et al U.S. Pat. No. 3,220,839and Knott et al U.S. Pat. No. 2,514,650; thiazolidines as illustrated by Scavron U.S. Pat. No. 3,565,625; peptide derivatives as illustrated by Maffet U.S. Pat. No. 3,274,002; pyrimidines and 3-pyrazolidones as illustrated by Welsh U.S. Pat. No. 3,161,515 and Hood et al U.S. Pat. No. 2,751,297; azotriazoles and azotetrazoles as illustrated by Baldassarri et al U.S. Pat. No. 3,925,086; azaindenes, particularly tetraazaindenes, as illustrated by Heimbach U.S. Pat. No. 2,444,605, Knott U.S. Pat. No. 2,933,388, Williams U.S. Pat. No. 3,202,512, *Research Disclosure*, Vol. 134, June, 1975, Item 13452, and Vol. 148, August, 1976, Item 14851, and Nepker et al U.K. Patent 1,338,567; mercaptotetrazoles, -triazoles and -diazoles as illustrated by Kendall et al U.S. Pat. No. 2,403,927, Kennard et al U.S. Pat. No. 3,266,897, *Research Disclosure*, Vol. 116, December, 1973, Item 11684, Luckey et al U.S. Pat. No. 3,397,987 and Salesin U.S. Pat. No. 3,708,303; azoles as illustrated by Peterson et al U.S. Pat. No. 2,271,229 and *Research Disclosure*, Item 11684, cited above; purines as illustrated by Sheppard et al U.S. Pat. No. 2,319,090, Birr et al U.S. Pat. No. 2,152,460, *Research Disclosure*, Item 13452, cited above, and Dostes et al French Patent 2,296, 204, polymers of 1,3-dihydroxy (and/or 1,3-carbamoxy)-2-methylenepropane as illustrated by Saleck et al U.S. Pat. No. 3,926,635 and tellurazoles, tellurazolines, tellurazolinium salts and tellurazolium salts as illustrated by Gunther et al U.S. Pat. No. 4,661,438, aromatic oxatellurazinium salts as illustrated by Gunther, U.S. Pat. No. 4,581,330 and Przyklek-Elling et al U.S. Pat. Nos. 4,661,438 and 4,677, 202. High-chloride emulsions can be stabilized by the presence, especially during chemical sensitization, of elemental sulfur as described by Miyoshi et al European published Patent Application EP 294,149 and Tanaka et al European published Patent Application EP 297,804 and thiosulfonates as described by Nishikawa et al European published Patent Application EP 293,917. In addition pH adjustment of emulsion prior to coating increases its stability. The usual range of useful pH, as known in the art lies between 4 and 7.

It is also specifically contemplated to blend the high chloride emulsions utilized herein with each other or with conventional emulsions to satisfy specific emulsion layer requirements. Instead of blending emulsions, the same effect can usually be achieved by coating the emulsions to be blended as separate layers in an emulsion unit. For example, coating of separate emulsion layers to achieve exposure latitude is well known in the art. It is further well known in the art that increased photographic speed can be realized when faster and slower silver halide emulsions are coated in separate layers. Typically the faster emulsion layer in an emulsion unit is coated to lie nearer the exposing radiation source than the slower emulsion layer. Coating the faster and slower emulsions in the reverse layer order can change the contrast obtained. This approach can be extended to three or more superimposed emulsion layers in an emulsion unit. Such layer arrangements are specifically contemplated in the practice of this invention.

A suitable multicolor, multilayer format for a recording element used in the electronic printing method of this invention is represented by Structure I.

| STRUCTURE I |
|---|
| Red-sensitized |
| cyan dye image-forming silver halide emulsion unit |
| Interlayer |
| Green-sensitized |
| magenta dye image-forming silver halide emulsion unit |
| Interlayer |
| Blue-sensitized |
| yellow dye image-forming silver halide emulsion unit |
| ///// Support ///// |

wherein the blue-sensitized, yellow dye image-forming silver halide emulsion unit is situated nearest the support; next in order is the green-sensitized, magenta dye image-forming unit, followed by the uppermost red-sensitized, cyan dye image-forming unit. The image-forming units are typically separated from each other by interlayers, as shown. Other multilayer formats for a recording element used in the electronic printing method are also possible.

The recording elements used in this invention can contain brighteners (Section VI), antifoggants and stabilizers (Section VII), antistain agents and image dye stabilizers (Section VII I and J), light absorbing and scattering materials (Section VIII), hardeners (Section II), coating aids (Section IX), plasticizers and lubricants (Section IX), antistatic agents (Section IX), and matting agents (Section IX all in *Research Disclosure*, September 1994, Item 36544.

The recording elements used in this invention can be coated on a variety of supports, as described in Section XV of *Research Disclosure* and references cited therein.

The recording elements used in this invention can be exposed to actinic radiation in a pixel-by-pixel mode as more fully described hereinafter to form a latent image and then processed to form a visible image, as described in Sections XVI, XVII, XIX and XX of *Research Disclosure*, Item 36544. Typically, processing to form a visible dye image includes the step of contacting the recording element with a color developing agent to reduce developable silver halide and oxidize the color developing agent. Oxidized color developing agent in turn reacts with the coupler to yield a dye. Preferred color developing agents are p-phenylenediamines. Especially preferred are 4-amino-3-methyl-N,N-diethylaniline hydrochloride, 4-amino-3-methyl-N-ethyl-N-β (methanesulfonamido)ethylaniline sulfate hydrate, 4-amino-3-methyl-N-ethyl-N-β hydroxyethylaniline sulfate, 4-amino-3-β (methanesulfon-amido) ethyl-N,N-diethylaniline hydrochloride, and 4-amino-N-ethyl-N-(2-methoxyethyl)m-toluidine di-p-toluenesulfonic acid.

With negative-working silver halide, the processing step described hereinbefore provides a negative image. The described elements can be processed in the color paper process Kodak™ Ektacolor RA-4 or Kodak™ Flexicolor color process as described in, for example, the British Journal of Photography Annual of 1988, pages 196–198.

The recording elements comprising the radiation sensitive high chloride emulsion layers according to this invention can be image-wise exposed in a pixel-by-pixel mode using suitable high energy radiation sources typically employed in electronic printing methods. Suitable actinic forms of energy encompass the ultraviolet, visible and infrared regions of the electromagnetic spectrum, as well as electron-beam radiation, and is conveniently supplied by beams from one or more light emitting diodes or lasers, including gaseous or solid state lasers. Exposures can be monochromatic, orthochromatic or panchromatic. For example, when the recording element is a multilayer multicolor element, exposure can be provided by laser or light emitting diode beams of appropriate spectral radiation, for example, infrared, red, green or blue wavelengths, to which such element is sensitive. Multicolor elements can be employed which produce cyan, magenta and yellow dyes as a function of exposure in separate portions of the electromagnetic spectrum, including at least two portions of the infrared region, as disclosed in the previously mentioned U.S. Pat. No. 4,619,892, incorporated herein by reference. Suitable exposures include those up to 2000 nm, preferably up to 1500 nm. The exposing source need, of course, provide radiation in only one spectral region if the recording element is a monochrome element sensitive to only that region (color) of the electromagnetic spectrum. Suitable light emitting diodes and commercially available laser sources are described in the examples. Image-wise exposures at ambient, elevated or reduced temperatures and/or pressures can be employed within the useful response range of the recording element determined by conventional sensitometric techniques, as illustrated by T. H. James, *The Theory of the Photographic Process,* 4th Ed., Macmillan, 1977, Chapters 4, 6, 17, 18 and 23.

The quantity or level of high energy actinic radiation provided to the recording medium by the exposure source is generally at least $10^{-4}$ ergs/cm$^2$, typically in the range of about $10^{-4}$ ergs/cm$^2$ to $10^{-3}$ ergs/cm$^2$ and often from $10^{-3}$ ergs/cm$^2$ to $10^2$ ergs/cm$^2$. Exposure of the recording element in a pixel-by-pixel mode as known in the prior art persists for only a very short duration or time. Typical maximum exposure times are up to 100 microseconds, often up to 10 microseconds, and frequently up to only 0.5 microsecond. As illustrated by the following Examples, excellent results are achieved with a laser beam at an exposure time of only 0.05 microsecond, and still lower exposure times down to 0.01 microsecond are contemplated. The pixel density is subject to wide variation, as is obvious to those skilled in the art. The higher the pixel density, the sharper the images can be, but at the expense of equipment complexity. In general, pixel densities used in conventional electronic printing methods of the type described herein do not exceed $10^7$ pixels/cm$^2$ and are typically in the range of about $10^4$ to $10^6$ pixels/cm$^2$. An assessment of the technology of high-quality, continuous-tone, color electronic printing using silver halide photographic paper which discusses various features and components of the system, including exposure source, exposure time, exposure level and pixel density and other recording element characteristics is provided in Firth et al., *A Continuous-Tone Laser Color Printer*, Journal of Imaging Technology, Vol. 14, No. 3, June 1988, which is hereby incorporated herein by reference. As previously indicated herein, a description of some of the details of conventional electronic printing methods comprising scanning a recording element with high energy beams such as light emitting diodes or laser beams, are set forth in Hioki U.S. Patent 5,126,235, European Patent Applications 479 167 A1 and 502 508 A1, the disclosures of which are hereby incorporated herein by reference.

The invention has been described in detail with particular reference to preferred embodiments thereof, but it will be understood that variations and modifications can be effected within the spirit and scope of the invention.

EXAMPLES

Emulsion A

This emulsion demonstrates the conventional cubic emulsion precipitated in oxidized gelatin and containing 0.3 mole percent of added iodide. A pure chloride silver halide emulsion was precipitated by equimolar addition of silver nitrate and sodium chloride into a well stirred reactor containing gelatin peptizer and an antifoaming pluronic agent.

A reaction vessel contained 4.5 L of a solution that was 7.9% in oxidized gelatin, 0.038 M in NaCl and contained 1.8 g of antifoamant. The contents of the reaction vessel were maintained at 55° C. and the pCl was adjusted to 1.7. To this stirred solution at 55° C. 27.7 mL of a solution 2.6 M in $AgNO_3$ and 26.9 mL of a solution 2.8M in NaCl were added simultaneously at 27.7 mL/min for 1 minute.

Then the 2.6M silver nitrate solution and the 2.8M sodium chloride solution were added simultaneously with a ramped linearly increasing flow from 27.7 mL/min to 123 mL/min over 20 minutes. The 2.6 M silver nitrate solution and 2.8M sodium chloride solution were then added simultaneously at 123 mL/min. After 93 mole percent of total silver was precipitated the silver and salts pumps were stopped and 300 mL of solution containing potassium iodide in an amount corresponding to 0.3 mole percent of total silver precipitated was pumped to the reactor at 200 mL/min. Then the 2.6M silver nitrate solution and 2.8M sodium chloride solution were added simultaneously at 123 mL/min for 3.7 minutes. The emulsion was cooled down to 40° C. over 5 minutes. The resulting emulsion was a cubic grain silver chloride emulsion of 0.4 μm in edgelength size. The emulsion was then washed using an ultrafiltration unit, and final pH and pCl were adjusted to 5.6 and 1.7 respectively.

Emulsion B

Same as Emulsion A except the silver nitrate solution contained $3\times10^{-7}$ mole of mercuric chloride per mole of silver.

Emulsion C

Same as Emulsion A except the silver nitrate solution contained $7.5\times10^{-5}$ mole of iodobenzene diacetate (Compound 1) per mole of silver.

Emulsion D

This emulsion demonstrates the conventional unripened cubic emulsion precipitated in oxidized gelatin. A pure chloride silver halide emulsion was precipitated by equimolar addition of silver nitrate and sodium chloride into a well stirred reactor containing gelatin peptizer and an antifoaming pluronic agent.

A reaction vessel contained 4.5 L of a solution that was 7.9% in oxidized gelatin, 0.038M in NaCl and contained 1.8 g of antifoamant. The contents of the reaction vessel were maintained at 55° C. and the pCl was adjusted to 1.7. To this stirred solution at 55° C. 27.7 mL of a solution 2.6M in $AgNO_3$ and 26.9 mL of a solution 2.8M in NaCl were added simultaneously at 27.7 mL/min for 1 minute. Then the 2.6M silver nitrate solution and the 2.8M sodium chloride solution were added simultaneously with a ramped linearly increasing flow from 27.7 mL/min to 123 mL/min over 20 minutes. The 2.6M silver nitrate solution and 2.8M sodium chloride solution were then added simultaneously at 123 mL/min for 40 minutes. Then emulsion was cooled down to 40° C. over 5 minutes. The resulting emulsion was a cubic grain silver chloride emulsion of 0.4 μm in edgelength size. The emulsion was then washed using an ultrafiltration unit, and final pH and pCl were adjusted to 5.6 and 1.7 respectively.

Emulsion Sensitization

The emulsions were optimally sensitized in the magenta or cyan finish format using conventional techniques. In each finish, the sequence of chemical sensitizer, spectral sensitizer, Lippmann silver bromide and antifoggants addition were the same. There were, however, two significantly different sensitization classes: gold-sulfide and gold(I)-plus-sulfur. Detailed procedures are described in the Examples below.

In the green-sensitized emulsion the following magenta sensitizing dye was used:

Dye SS-1

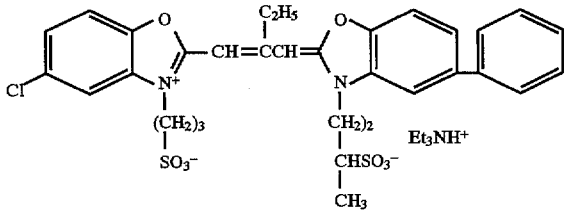

Just prior to coating on resin coated paper support the green-sensitized emulsions were dual-mixed with magenta dye forming coupler:

Coupler I

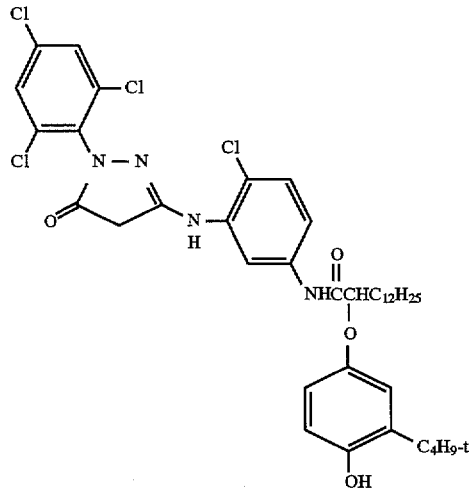

In the red-sensitized emulsions the following cyan sensitizing dye was used:

Dye SS-2

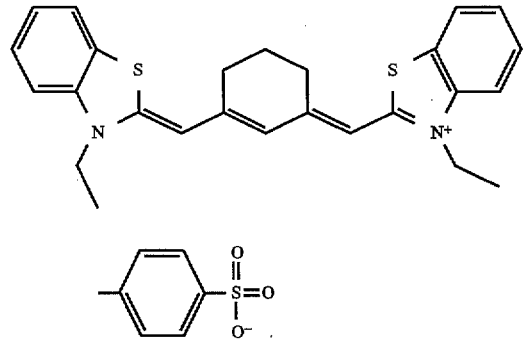

Just prior to coating on resin coated paper support the red-sensitized emulsions were dual-mixed with magenta dye forming coupler:

Coupler 2

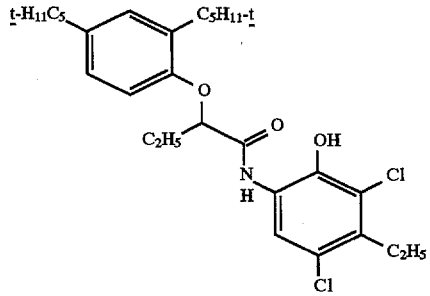

The green-sensitized emulsions were coated at 26 mg silver per square foot while the red-sensitized emulsions were coated at 17 mg silver per square foot on resin-coated paper support. The coatings were overcoated with a gelatin layer and the entire coating was hardened with bis (vinylsulfonylmethyl)ether.

The coatings were exposed through a step wedge with 3000° K tungsten source at exposure time of 0.10 second.

The coatings were also exposed through a step wedge with 3000° K tungsten source at a high-intensity short exposure time of $10^{-4}$ and a long exposure time of $10^{-2}$ second. The total energy of each exposure was kept at a constant level. Speed is reported as 100 × the relative log speed at specified level above the minimum density as presented in the following Examples. In these relative speed units a speed difference of 30, for example, is a difference of 0.30 logE, where E is exposure in lux-seconds. These exposures will be referred to as "Optical Sensitivity" in the following Examples.

The magenta and cyan coatings were also exposed with a laser sensitometer at 543 nm or 690 nm respectively, with a resolution of 250 pixels/inch, a pixel pitch of 50.8 μm, and an exposure time of 1 microsecond per pixel. These exposures will be referred to as "Digital Sensitivity" in the following Examples.

All the coatings were processed in KODAK™ Ektacolor RA-4.

EXAMPLE 1

This example compares silver chloroiodide cubic emulsions doped with mercury or iodobenzene diacetate during precipitation, and sensitized for the magenta color record. The sensitization details were as follows:

Part 1.1: A portion of silver chloride Emulsion A was optimally sensitized by the addition of the optimum amount of green sensitizing dye (SS-1) followed by addition of the optimum amount of colloidal gold-sulfide followed by heat ramp up to 60° C. for 45 minutes. Then the emulsion was cooled down to 40° C. and 1-(3-acetamidophenyl)-5-mercaptotetrazole was added followed by the addition of Lippmann silver bromide.

Part 1.2: A portion of silver chloride Emulsion B 5 was sensitized identically as in Part 1.1.

Part 1.3: A portion of silver chloride Emulsion C was sensitized identically as in Part 1.1.

The sensitometric data are summarized in Table I.

TABLE I

| | Optical Sensitivity | | | | Digital Sensitivity | |
|---|---|---|---|---|---|---|
| Emulsion | $10^{-2}$ sec exposure | | $10^{-4}$ sec exposure | | $1 \times 10^{6}$ sec exposure | |
| Finish | Dmin + 0.15 | Dmin + 1.95 | Dmin + 0.15 | Dmin + 1.95 | Dmin + 0.15 | Dmin + 1.95 |
| Part 1.1 | 281 | 100 | 280 | 0.012 | 610 | 100 |
| Part 1.2 | 329 | 219 | 324 | 208 | 810 | 550 |
| Part 1.3 | 332 | 226 | 329 | 212 | 810 | 567 |

The gold sulfide sensitized unripened silver chloride emulsions exhibit the beneficial effect of iodobenzene diacetate incorporation into the grain during precipitation when sensitized in the magenta finish format. The presence of iodobenzene diacetate in silver chloride emulsions significantly improves emulsion speed and contrast when sensitized in the magenta finish format in the presence of Lippmann bromide, especially at shoulder portions of the sensitometric curve. High speed generated by laser exposures at higher densities is especially important in digital imaging. The last three columns of Table I are most important for illustrating the invention as these digital exposure times are of most interest.

EXAMPLE 2

This example compares unripened pure silver chloride cubic emulsions sensitized in the presence of iodobenzene diacetate for the magenta color record. The sensitization details were as follows:

Part 2.1: A portion of silver chloride Emulsion D was sensitized identically as in Part 1.1.

Part 2.2: A portion of silver chloride Emulsion D was sensitized identically as in Part 1.1 except that 2 mg of iodobenzene diacetate/Ag mole was added as the first addendum in the finish.

Part 2.3: A portion of silver chloride Emulsion D was sensitized identically as in Part 1.1 except that 10 mg of iodobenzene diacetate/Ag mole was added as the first addendum in the finish.

Part 2.4: A portion of silver chloride Emulsion D was sensitized identically as in Part 1.1 except that 25 mg of iodobenzene diacetate/Ag mole was added as the first addendum in the finish.

Part 2.5: A portion of-silver chloride Emulsion D was sensitized identically as in Part 1.1 except that 35 mg of iodobenzene diacetate/Ag mole was added as the first addendum in the finish.

Part 2.6: A portion of silver chloride Emulsion D was sensitized identically as in Part 1.1 except that 50 mg of iodobenzene diacetate/Ag mole was added as the first addendum in the finish.

The sensitometric data are summarized in Table II.

TABLE II

| | Effect of IBDA in the magenta finish on reciprocity | | | | | |
|---|---|---|---|---|---|---|
| | Optical Sensitivity | | | | Digital Sensitivity | |
| Emulsion | $10^{-2}$ sec exposure | | $10^{-4}$ sec exposure | | $1 \times 10^{6}$ sec exposure | |
| Finish | Dmin + 0.15 | Dmin + 1.95 | Dmin + 0.15 | Dmin + 1.95 | Dmin + 0.15 | Dmin + 1.95 |
| Part 2.1 | 149 | 100 | 148 | 88 | 248 | 100 |
| Part 2.2 | 151 | 103 | 149 | 93 | 338 | 209 |

TABLE II-continued

| Effect of IBDA in the magenta finish on reciprocity | | | | | | |
|---|---|---|---|---|---|---|
| | Optical Sensitivity | | | | Digital Sensitivity | |
| Emulsion | $10^{-2}$ sec exposure | | $10^{-4}$ sec exposure | | $1 \times 10^{6}$ sec exposure | |
| Finish | Dmin + 0.15 | Dmin + 1.95 | Dmin + 0.15 | Dmin + 1.95 | Dmin + 0.15 | Dmin + 1.95 |
| Part 2.3 | 151 | 105 | 149 | 94 | 319 | 213 |
| Part 2.4 | 150 | 103 | 151 | 96 | 317 | 223 |
| Part 2.5 | 150 | 103 | 151 | 96 | 323 | 216 |
| Part 2.6 | 151 | 105 | 151 | 97 | 319 | 212 |

The gold-sulfide sensitized unripened silver chloride cubic emulsions exhibit the beneficial effect of iodobenzene diacetate incorporation into the grain surface during sensitization in the magenta finish format. Larger losses of speed at short exposure times ($10^{-4}$ second) are somewhat improved. Gold-sulfide sensitized magenta emulsions exhibit large effects of iodobenzene diacetate incorporation on both reciprocity and speed from laser exposures, especially at shoulder portion of the sensitometric curve (at densities 1.95 above $D_{min}$). High shoulder speed generated by laser exposure is especially important in digital imaging. The last three columns of Table II are most important for illustrating the invention, as the short exposure times are of most interest.

EXAMPLE 3

This example compares unripened pure silver chloride cubic emulsions made in oxidized gelatin and sensitized in the presence of iodobenzene diacetate for the cyan color record. The sensitization details were as follows:

Part 3.1: A portion of silver chloride Emulsion D was optimally sensitized by the addition of the optimum amount of stilbene followed by heat ramp up to 65° C. The emulsion was hold at 65° C. for 10 minutes, and then Lippmann silver bromide was added followed by the optimum amount of gold(I). Then subsequently optimum amount of sulfur was added followed by addition of cyan spectral sensitizing dye (SS-2) followed by addition of 1-(3-acetamidophenyl)-5-mercaptotetrazole. Then the emulsion was cooled down to 40° C.

Part 3.2: A portion of silver chloride Emulsion D was sensitized identically as in Part 3.1 except that 2 mg of iodobenzene diacetate/Ag mole was added as the first addendum in the finish.

Part 3.3: A portion of silver chloride Emulsion D was sensitized identically as in Part 3.1 except that 10 mg of iodobenzene diacetate/Ag mole was added as the first addendum in the finish.

Part 3.4: A portion of silver chloride Emulsion D was sensitized identically as in Part 3.1 except that 25 mg of iodobenzene diacetate/Ag mole was added as the first addendum in the finish.

Part 3.5: A portion of silver chloride Emulsion D was sensitized identically as in Part 3.1 except that 35 mg of iodobenzene diacetate/Ag mole was added as the first addendum in the finish.

Part 3.6: A portion of silver chloride Emulsion D was sensitized identically as in Part 3.1 except that 50 mg of iodobenzene diacetate/Ag mole was added as the first addendum in the finish.

The sensitometric data are summarized in Table III.

TABLE III

| Effect of IBDA in the magenta finish on reciprocity | | | | | | |
|---|---|---|---|---|---|---|
| | Optical Sensitivity | | | | Digital Sensitivity | |
| Emulsion | $10^{-2}$ sec exposure | | $10^{-4}$ sec exposure | | $1 \times 10^{6}$ sec exposure | |
| Finish | Dmin + 0.15 | Dmin + 1.95 | Dmin + 0.15 | Dmin + 1.95 | Dmin + 0.15 | Dmin + 1.95 |
| Part 3.1 | 239 | 100 | 234 | 48 | 281 | 100 |
| Part 3.2 | 242 | 110 | 236 | 62 | 393 | 125 |
| Part 3.3 | 237 | 106 | 230 | 59 | 375 | 118 |
| Part 3.4 | 237 | 106 | 232 | 62 | 375 | 120 |
| Part 3.5 | 238 | 112 | 233 | 68 | 375 | 122 |
| Part 3.6 | 236 | 106 | 231 | 62 | 374 | 121 |

The silver chloride cubic emulsions precipitated in oxidized gelatin exhibit the beneficial effect of iodobenzene diacetate incorporation into the grain surface during sensitization in the cyan gold(I)-plus-sulfur finish format. Larger losses of speed at short exposure times ($10^{-4}$ and $10^{-6}$ second) are significantly improved.

The invention has been described in detail with particular reference to the preferred embodiments thereof, but it will be understood that variations and modifications can be effected within the scope of the invention.

We claim:

1. A silver halide photographic element for digital exposure comprising a cubical silver chloride emulsion precipitated and/or chemically sensitized in the presence of an aryliodonium compound represented by the formula:

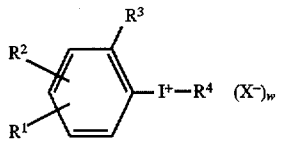

wherein $R^1$ and $R^2$ and $R^3$ are independently H, or aliphatic, aromatic or heterocyclic groups, alkoxy groups, hydroxy groups, halogen atoms, aryloxy groups, alkylthio groups, arylthio groups, acyl groups, sulfonyl groups, acyloxy groups, carboxyl groups, cyano groups, nitro groups, sulfo groups, alkylsulfoxide or trifluoralkyl groups, or any two of $R^1$, $R^2$ and $R^3$ together represent the atoms necessary to form a five or six-membered ring or a multiple ring system;

$R^4$ is a carboxylate salt or $0^-$; w is 0 or 1; and $X^-$ is an anionic counter ion; with the proviso that when $R^3$ is a carboxyl or sulfo group, w is 0 and $R^4$ is $0^-$.

2. The photographic element of claim 1 wherein $R^1$, $R^2$ and $R^3$ are independently H, halogen atoms, or aliphatic, aromatic or heterocyclic groups.

3. The photographic element of claim 2 wherein $R^1$, $R^2$ and $R^3$ are independently H, an alkyl group having 1 to 10 carbon atoms or an aryl group having 6 to 10 carbon atoms.

4. The photographic element of claim 1 wherein $R^1$ and $R^2$ are independently H, halogen atoms, or aliphatic, aromatic or heterocyclic groups and $R^3$ is a sulfo or carboxyl group.

5. The photographic element of claim 4 wherein $R^1$ and $R^2$ are independently H, an alkyl group having 1 to 10 carbon atoms or an aryl group having 6 to 10 carbon atoms.

6. The photographic element of claim 1 wherein $R^4$ is acetate, formate, benzoate or trifluoroacetate.

7. The photographic element of claim 1 wherein the concentration of the aryliodonium compound is from $1\times10^{-9}$ to $10\times10^{-3}$ mol/mol Ag.

8. The photographic element of claim 7 wherein the silver halide emulsion is chemically sensitized in the presence of the aryliodonium compound and the concentration of the aryliodonium compound is from $10\times10^{-7}$ to $1\times10^{-3}$ mol/mol Ag.

9. The photographic element of claim 1 wherein the silver halide emulsion is precipitated in the presence of the aryliodonium compound.

10. The photographic element of claim 9 wherein the concentration of the aryliodonium compound is from $1\times10^{-9}$ to $1\times10^{-4}$ mol/mol Ag.

11. The photographic element of claim 1 wherein the emulsion was precipitated in oxidized gelatin.

12. The photographic element of claim 1 wherein the emulsion has been chemically sensitized with a gold compound, a sulfur-containing compound and Lippmann silver bromide.

13. A method of making a cubical silver chloride emulsion comprising precipitating and chemically sensitizing the emulsion and further comprising adding to the emulsion at any time before or during chemical sensitization an aryliodonium compound represented by the formula:

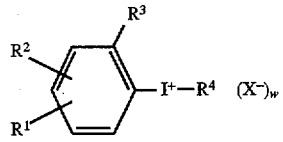

wherein $R^1$ and $R^2$ and $R^3$ are independently H, or aliphatic, aromatic or heterocyclic groups, alkoxy groups, hydroxy groups, halogen atoms, aryloxy groups, alkylthio groups., arylthio groups, acyl groups, sulfonyl groups, acyloxy groups, carboxyl groups, cyano groups, nitro groups, sulfo groups, alkylsulfoxide or trifluoralkyl groups, or any two of $R^1$, $R^2$ and $R^3$ together represent the atoms necessary to form a five or six-membered ring or a multiple ring system;

$R^4$ is a carboxylate salt or $0^-$; w is 0 or 1; and $X^-$ is an anionic counter ion; with the proviso that when $R^3$ is a carboxyl or sulfo group, w is 0 and $R^4$ is $0^-$.

14. The method of claim 13 wherein $R^1$, $R^2$ and $R^3$ are independently H, halogen atoms, or aliphatic, aromatic or heterocyclic groups.

15. The method of claim 14 wherein $R^1$, $R^2$ and $R^3$ are independently H, an alkyl group having 1 to 10 carbon atoms or an aryl group having 6 to 10 carbon atoms.

16. The method of claim 13 wherein $R^1$ and $R^2$ are independently H, halogen atoms, or aliphatic, aromatic or heterocyclic groups and $R^3$ is a sulfo or carboxyl group.

17. The method of claim 16 wherein $R^1$ and $R^2$ are independently H, an alkyl group having 1 to 10 carbon atoms or an aryl group having 6 to 10 carbon atoms.

18. The method of claim 13 wherein $R^4$ is acetate, formate, benzoate or trifluoroacetate.

19. The method of claim 13 wherein the concentration of the aryliodonium compound added is from $1\times10^{-9}$ to $10\times10^{-3}$ mol/mol Ag.

20. The method of claim 13 wherein the aryliodonium compound is added at the start of or during precipitation of the silver halide emulsion.

21. The method of claim 20 wherein the concentration of the aryliodonium compound added is from $1\times10^{-9}$ to $1\times10^{-4}$ mol/mol Ag.

22. The method of claim 13 wherein the emulsion is precipitated in oxidized gelatin.

23. The method of claim 13 wherein the emulsion is chemically sensitized with a gold compound, a sulfur-containing compound and Lippmann silver bromide.

* * * * *